United States Patent [19]

Weber

[11] 4,228,563

[45] Oct. 21, 1980

[54] DRIVE APPARATUS OF A CAN FOR DEPOSITING TEXTILE FIBRE SLIVERS

[75] Inventor: Kurt Weber, Elgg, Switzerland

[73] Assignee: Rieter Machine Works Ltd., Winterthur, Switzerland

[21] Appl. No.: 15,348

[22] Filed: Feb. 26, 1979

[30] Foreign Application Priority Data

Mar. 3, 1978 [CH] Switzerland ..... 2320/78

[51] Int. Cl.[3] ..... B65H 54/80

[52] U.S. Cl. ..... 19/159 R

[58] Field of Search ..... 19/159 R, 159 A, 159; 68/177; 100/82; 28/289

[56] References Cited

U.S. PATENT DOCUMENTS 2,404,742 7/1946 Polak et al. ..... 19/159 R

*Primary Examiner*—Louis Rimrodt

*Attorney, Agent, or Firm*—Werner W. Kleeman

[57] ABSTRACT

Drive apparatus for a spinning can (4) effecting a rotational movement about its own axis (a) for depositing textile fibre slivers on spinning preparatory machines. The axis (a) of the can itself rotates about an axis (b) which is fixed relative to the room and which is parallel to the can axis (a). The can (4) is placed and centered on a can table (5) which is rotatably supported in a plate (7), and which is set into rotation by a rotating means (8) and is provided with a driving element (22). The plate (7) is horizontally supported on at least three points and performs a translatory circular movement activated by two cranks (14,15) moving mutually parallel. The drive element (22) of the table (5) is rotatably connected with at least one crank (14 or 15). The translatory circular movement of the plate (7) about the axis (b) is derived from the rotational movement of the can table (5) about its own axis (a).

18 Claims, 7 Drawing Figures

2
f
1
3
4
g
a
b
10
8
9
12
7
13
24
5
6
16
25
14
18
22
15
17
11
19
23
21
20 t
7
8
9
I
a
4
22
5
10
24
9'
13
b
II
16
19
17
12
18
P
III
20
t
m
23
t
21
25
n 4
a
10
30
29
28
t
26
22
7
27
11
31
23
32

38
t
46
33
53
44
VII
VII
54
48

VI
VI
54
53
46
44

DRIVE APPARATUS OF A CAN FOR DEPOSITING TEXTILE FIBRE SLIVERS

BACKGROUND OF THE INVENTION

The present invention concerns a drive apparatus of a can for depositing textile fibre slivers in spinning preparatory machines, in which the can effects a rotational movement about its axis, and in which the axis of the can in turn rotates about an axis parallel to it, which is fixed with respect to the room.

In a known drive apparatus of the above mentioned type (U.S. Pat. No. 2,404,742) a circular plate rotating about a vertical axis is provided. In a point of this plate, located outside its rotational axis, a second axis is supported, which is rigidly and concentrically connected with a vertical pot or can for depositing freshly spun endless filament strands. As this second axis rotates, the pot or can thus rotates about its own longitudinal axis. For rotating the plate about its vertical axis and for rotating the can or pot about its longitudinal axis, separate and independent drive means are provided. Due to the application of two separate drive means for the plate and for the can this known device becomes too complicated and expensive. Furthermore, the two separate drive means, arranged below the plate, require a great design height, such that an application of this design type with the can height normally used today in staple fibre mills of up to 1,2 m would result in an undesirable machine height for operating the machine.

In another known drive mechanism of a can for depositing staple fibre slivers (Japanese Patent Publication 48-3091) the can rotates about an axis which effects a linear translatory movement with respect to the room. In this arrangement also, separate drive means are provided for the two can movements, derived from a main drive. This drive arrangement also presents the disadvantages described with reference to the above mentioned solution.

SUMMARY OF THE INVENTION

It thus is the object of the present invention to create a drive apparatus of a can for depositing textile fibre slivers on spinning preparatory machines of the type mentioned initially, which eliminates the disadvantages of the drive arrangements known thus far, and which in particular is to be of simple design, economically feasible and generating little noise, not requiring much maintenance, and permitting optimum operating conditions at the spinning preparatory machine owing to its design.

The object is achieved according to the invention by the drive apparatus of a can for depositing textile fibre slivers on spinning preparatory machines of the type mentioned initially in such manner, that a can table is provided which takes up and centres the can, and which is driven and is rotatably supported in a plate which it sets into a translatory circular motion.

Owing to the fact, that in the inventive drive apparatus the rotational movement of the can axis about an axis, which is fixed relative to the room, is derived drivewise from the rotational movement of the table which takes up the can, the two separate drive means as compared with the state of the art, in this arrangement can be dispensed with.

According to an alternative design example of the invention the can table is set into rotation by a force transmission element and is provided with a plate friction element.

Furthermore, the plate can be supported horizontally movable, and a translatory circular movement can be imparted to it by two cranks moving mutually parallel.

The plate friction element can be arranged in rotatable connection with at least one crank, according to a further alternative design example.

According to an alternative design example of the invention furthermore a plurality of can tables can be rotatably supported in one plate.

As force transmission means flexible endless elements, such as e.g. toothed belts or sprocket chains, can be applied in particularly advantageous manner.

If, as in the above mentioned design example, a plurality of can tables is rotatably supported on one single plate, it furthermore proves particularly advantageous, if all can tables are set into rotation by one single, flexible endless force transmission element.

Furthermore, according to the invention, an arrangement can be provided, in which at least one of the cranks also serves as a support of the plate.

According to another alternative embodiment of the invention the arm length of the crank can be adaptable in such manner that the shape of the fibre sliver windings to be deposited in the spinning can can be optimized.

BRIEF DESCRIPTION OF THE DRAWINGS

The invention is described in more detail in the following with reference to illustrated design examples. It is shown in.

DETAILED DESCRIPTION OF THE PREFERRED EMBODIMENTS

Figure 1:
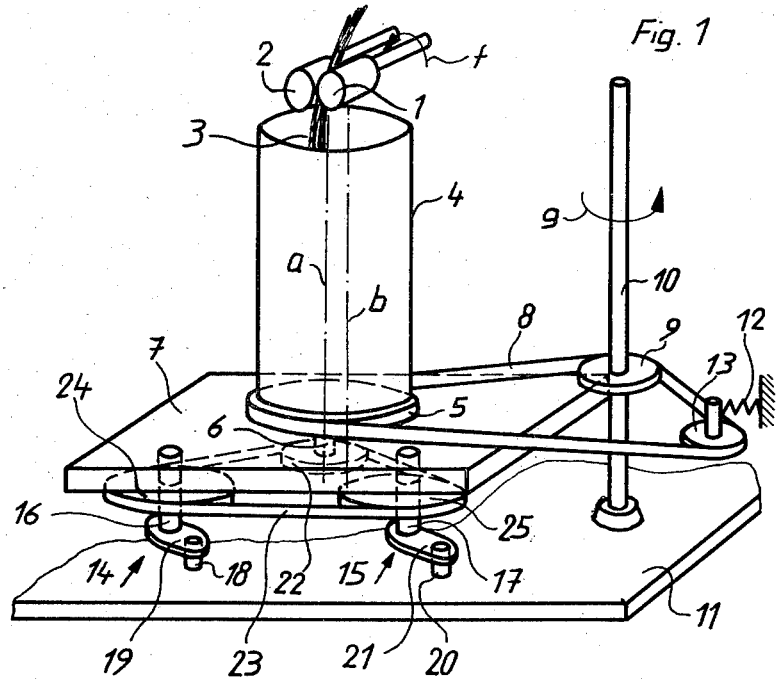
FIG. 1 a schematic, axonometric view of the inventive drive apparatus.

In FIG. 1 the rolls 1 and 2 of a pair of delivery rolls of a spinning preparatory machine, not shown in greater detail, deliver a textile fibre sliver 3. The fibre sliver 3 is deposited in a can 4 arranged below the pair of rolls 1,2 the longitudinal axis of the can being arranged vertically. The rotation of the roll 1 about its axis is indicated by arrow f. The roll 2 rotates in the opposite direction, and both rolls 1 and 2 form a nip line. The rolls 1 and 2 are driven in known manner and thus not shown further. Furthermore, the pair of rolls 1,2 can perform further movements relative to the room or space, and can e.g. rotate as a whole about a vertical axis which is not shown. Such movements can be aimed at depositing the fibre sliver 3 into the can 4 according to specific functions. Such functions, however are not within the scope of the present invention, and thus are not described further.

The can 4 is placed and centered on a can table 5. The can table 5 at its underside is provided with a concentric axle or shaft 6, which is rotatably supported in a plate 7. The can table 5 is driven by a toothed belt 8, which surrounds the can table 5 directly on its circular surface, and in place of which any other desired force transmission element could be applied. The can table 5 rotates about its rotational axis a, which coincides with the longitudinal axis of the can 4. This rotation is effected by the toothed belt 8, which revolves or circulates about a drive pulley 9 rigidly mounted on a vertical shaft 10 which is rotatably supported at points not moving relative to the room. The shaft 10 in this arrangement is e.g. supported at its lower end in a frame base 11 not moving relative to the room, whereas the upper support of the shaft 10 is not illustrated. The shaft 10 is driven in the direction of arrow g by means also not shown.

The belt drive arrangement for driving the can table 5 furthermore comprises a tension roll 13 tensioned by a spring 12 for tensioning the toothed belt 8.

Figure 2:
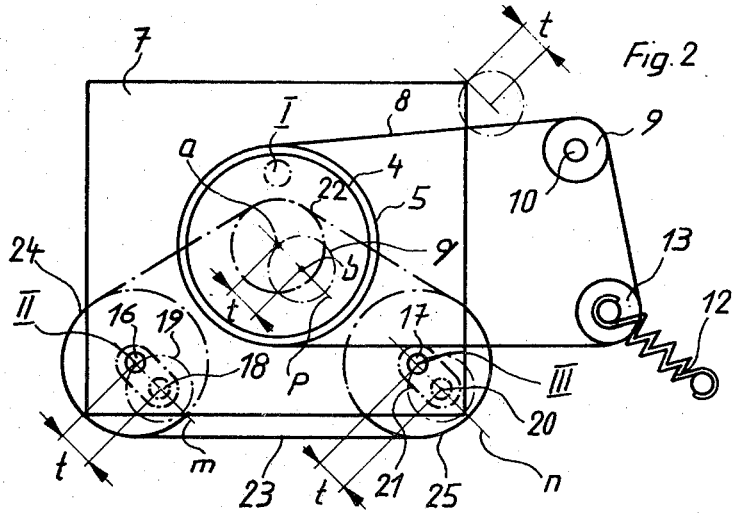
FIG. 2 a schematic top view of the drive apparatus according to FIG. 1.

The plate 7 according to the invention is movably supported on three points I,II and III (FIG. 2). In this arrangement the support point I is designed as a sliding or rolling support, which permits two degrees of freedom of movement, whereas the support points II and III are designed as part of two cranks 14 and 15. Also, three or more support points designed in analogy to the support point I can be provided: in this case the cranks 14 and 15 no longer effect a support function for the plate 7 and thus merely are to be connected rotatably with one of their shafts 16 or 17 respectively.

The crank 14 comprises the above mentioned shaft 16, the second shaft 18 arranged parallel to shaft 16, and the crank arm 19 connecting the shafts 16 and 18. The crank 15, comprising a shaft 17, a shaft 20 and a crank arm 21 is designed in the same manner and with the same dimensions as the crank 14. The distance t (FIG. 2) between the parallel shafts 16 and 18, or 17 and 20 respectively, represents the arm length of the cranks 14 and 15. The shafts 18 and 20 are rotatably supported in the frame base 11 of the machine, at a mutual distance which exactly corresponds to the distance of the supports of the shafts 16 and 17 provided in the plate 7.

The cranks 14 and 15 now move mutually parallel, and their rotation about the fixed axes or shafts 18, and 20 respectively, is derived from the rotation of the can table 5. This is effected in that the can table 5 comprises a drive element in the form of a toothed belt pulley 22 mounted onto the axle or shaft 6, which pulley 22 via the toothed belt 23 drives without slippage the toothed belt pulleys 24 and 25 respectively, which are rigidly mounted on the axes 16, and 17 respectively. The two cranks 14 and 15 thus function as a parallel guide of the plate 7. As the axes or shafts 16 and 17 respectively, perform a circular movement of the radius t about the axes or shafts 18 and 20 respectively, while the pulleys 24 and 25 respectively, rotate, each point of the plate 7 also moves on a cirular path of the radius t. In FIG. 2 the circular path q of the can axis consists of a circle of the radius t, the centre b of which is located on line p parallel to the mutually parallel connecting lines m and n connecting the axles 16 and 18, and the axles 17 and 20 respectively. The centre b corresponds to the axle b which does not move with respect to the room (FIG. 1), about which the axis a of the can rotates. By suitably choosing the diameters of the pulleys 22 and 24 and 25 respectively, the ratio of the number of turns of the can about its axis a to the number of turns of the can axis a about the fixed axle b can be adapted to any desired value. Also, by adapting the arm length t of the crank 14 and 15 respectively, e.g. as described later on with reference to FIGS. 6 and 7, the radius of the translatory rotational movement of the can axis about the axle b, which is fixed relative to the room, can be adapted to the optimum conditions.

Furthermore, instead of the toothed belt 8 in a drive apparatus such as e.g. shown in FIGS. 1 and 2, also a sprocket chain (not shown) can be applied or, if slippage-free transmission of the movement from the drive shaft 10 to the can table 5 is not required, also a flat drive belt can be applied.

Figure 3:
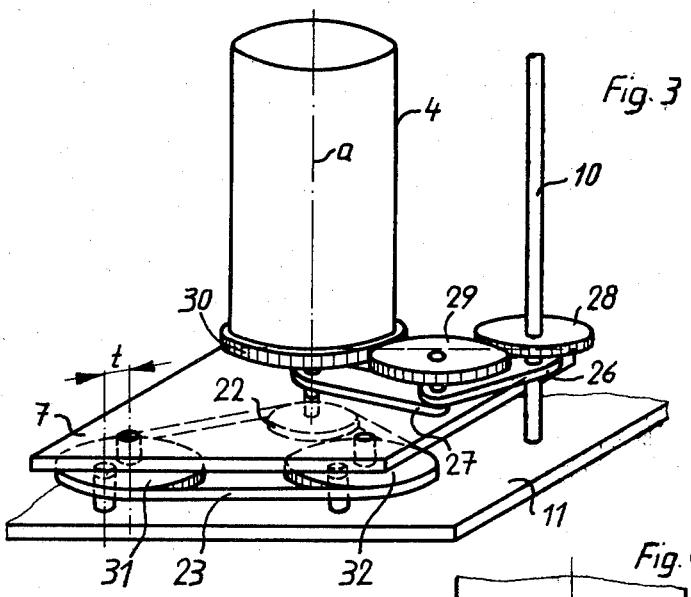
FIG. 3 a further alternative design example of the inventive drive apparatus, shown in a schematic, axonometric view, FIG. 4 an alternative design example of the inventive drive apparatus, shown in a section along the line IV—IV of FIG. 5, FIG. 5 the drive apparatus according to FIG. 4, shown in a section along the line V—V of FIG. 4, FIG. 6 a partial enlarged view of a drive apparatus corresponding to the one shown in FIGS. 4 and 5, shown in a section along the line VI—VI of FIG. 7, FIG. 7 a partial view of the drive apparatus according to FIG. 6, shown in a section along the line VII—VII of FIG. 6.

In FIG. 3, in which elements identical with the ones shown in FIG. 1 are designated with the same reference numbers, an alternative embodiment of the inventive drive apparatus is shown, which differs from the one shown in FIGS. 1 and 2 in two characteristics. Thus, here as force transmission means, in a manner known as such, a plurality (e.g. three) mutually meshing gears 28,29 and 30 are provided, arranged on a knee lever system formed by the two levers 26 and 27. The gear 30 also forms the can table, on which the can 4 is placed and centered. Owing to the knee lever system described, also in this arrangement it can be achieved that the can table 30, the centre of which describes a circle of the radius t, can be driven from the shaft 10 which does not move relative to the room. The knee lever system continuously bridges the varying distance between the rotational axis a of the can 4 and the shaft 10. Furthermore, the drive apparatus shown in FIG. 3 differs from the one according to FIGS. 1 and 2 in that the crank arm and the belt pulley are replaced by one single element, namely by the toothed belt pulley 31 or 32 respectively. The pulleys 31 and 32 themselves in this arrangement also function as cranks, in that the pulley body contains the crank arm. This embodiment, compared with the one shown in FIGS. 1 and 2, shows the advantage that the distance between the plate 7 and the frame base 11 can be reduced. The design height of the whole apparatus thus is reduced, simplified and easier to operate instead of the toothed belt 23 of the design examples according to FIGS. 1, 2 and 3. Of course also a sprocket chain (not shown) can be applied. Just a slippage-free drive transmission is required between the drive element 22 of the can table 5 or 30 respectively, and the crank 14, 15, or the pulleys 31,32 forming the crank.

Furthermore a rotatable connection of only one of the cranks 14,15, or of the pulleys 31,32, directly with drive element 22 of the table 5 or 30 respectively, can be provided. In this case, however, both cranks 14,15 or 31,32 are to be mutually coupled by a connecting element, which is not shown, in such manner that they run parallel at all times.

Figure 4:
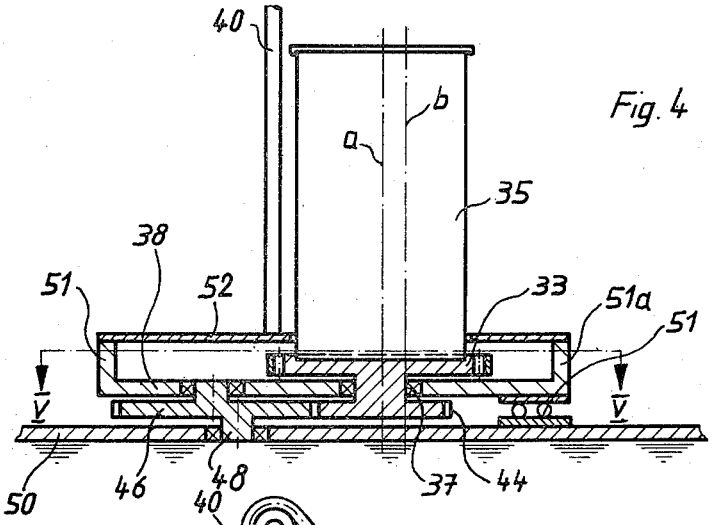
Figure 5:
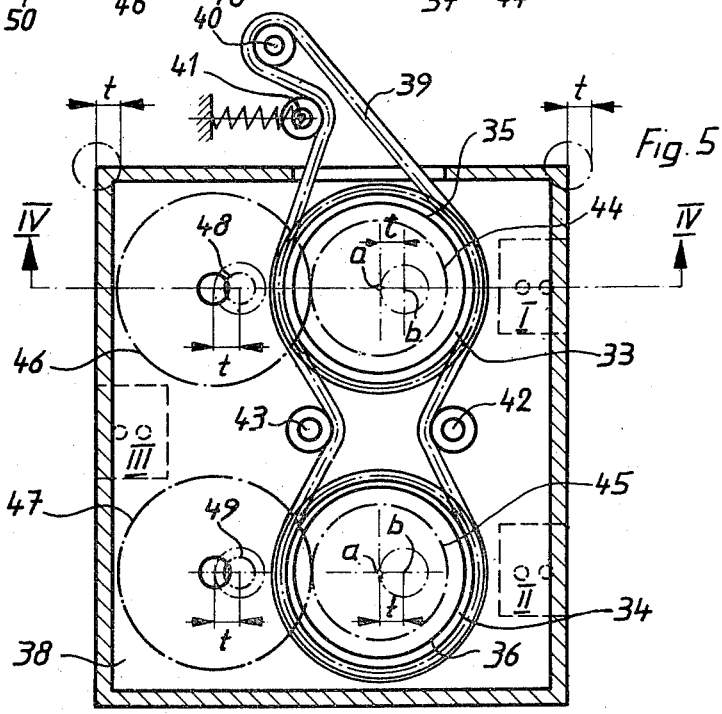

In FIGS. 4 and 5 an alternative design example of the invention drive apparatus is shown, in which a plurality of can tables, e.g. two can tables, are supported in one single plate. According to FIG. 5 the two tables 33 and 34 for the cans 35 and 36 respectively, are rotatably supported in antifriction bearings 37 (FIG. 4) in the plate 38 and are set into rotation by a shaft 40, which does not move relative to the room, via one single toothed belt 39. The belt 39 is tensioned by a tension roll 41. For increasing the wrapping angle of the belt 39 on the two can tables 33 and 34, two deflection rolls 42 and 43 are provided furthermore on the plate 38 between the two can tables 33 and 34.

Both can tables 33 and 34 furthermore are provided with a gear 44 and 45 each placed below the plate 38. The cranks in this arrangement are formed by gears 46 and 47 centrically supported in the plate 38, and excentrically supported with their excentrically arranged support pins 48 and 49 respectively, in the frame base 50 of the spinning preparatory machine. The gears 46 and 47 directly mesh with the gears 44 and 45 respectively. In this arrangement also each point of the plate 38 covers a circular path of the radius t while the can tables 33 and 34 rotate about their symmetry axis a, the radius t again corresponding to the crank arm length. Here the axis not moving with respect to the room or space again is designated b, about which the axis a of the can rotates.

By suitably choosing the diameters of the gears 44 and 46, and 45 and 47 respectively, the ratio of the number of turns of the axis a of the cans 35, and 36 respectively, about the corresponding fixed axis b to the number of turns of the cans about their own axis a can be adapted to all requirements.

In FIGS. 4 and 5 furthermore the support of the plate 38 on the points I,II and III (FIG. 5) using antifriction bearings 51 is shown. Such antifriction bearings permitting two degrees of freedom of movement being available on the market and thus, no further description is required in this context. They permit reduction of the friction caused by the circular translatory movement of the plate 38, to a minimum.

Furthermore, the plate 38 is provided along its circumference with a rim 51*a* onto which a cover plate 52 is placed. Thus the room of the toothed belt drive arrangement 39 is protected towards the upper side against the danger of accidents or of contamination.

Figure 6:
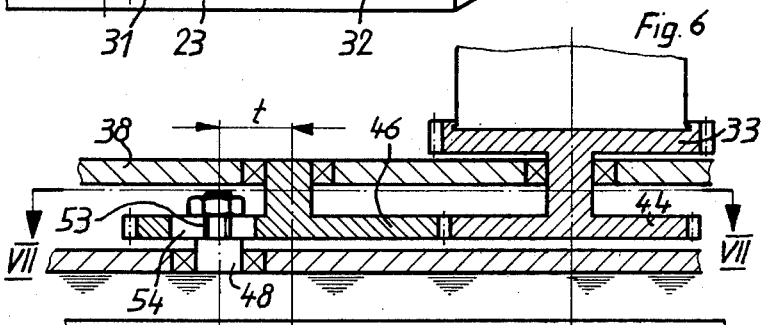
Figure 7:
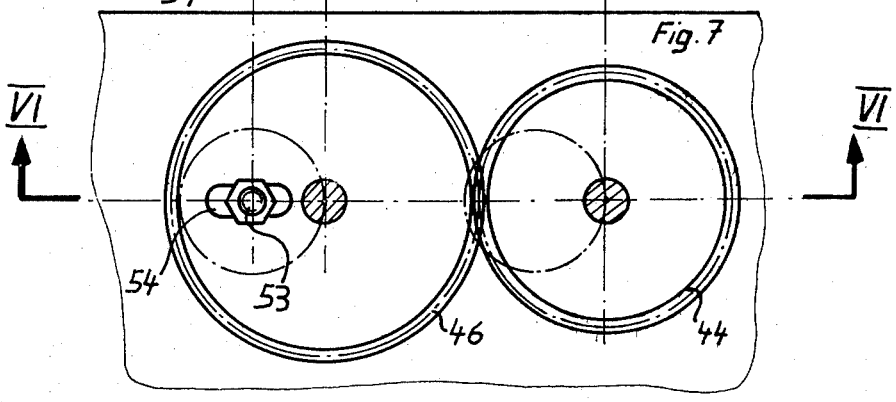

In FIGS. 6 and 7, in which a partial view of the drive apparatus according to FIGS. 4 and 5 is shown, an illustration is given, how the arm length t of the cranks is rendered adaptable. For achieving the adaptability, the pin 48 is fixed in the gear 46 using a screw connection 53, a longitudinal slot 54 extending radially, being provided in the gear 46. By moving the screw connection 53 in the slot 54 the distance t, i.e. the arm length of the crank, can be adapted. This arrangement, as shown for the gears 46 and 47, designed as cranks, can be applied similarly without difficulties also on the cranks 14 and 15, and 31 and 32 respectively.

The inventive drive apparatus of a can for depositing textile fibre slivers on spinning preparatory machines is characterized by the following main advantages.

(a) the design is simple and economically feasible; the two movements of the can (i.e. the rotation of the can about its own axis and the translatory circular movement of the can about a fixed axis) are derived from one single drive element (e.g. the shaft 10 or 40 respectively), (b) owing to the neat guidance of the plate using two cranks and owing to its support using antifriction elements, precise movements of the plate causing little vibration and noise are generated, which permit precise deposition of the fibre slivers in the can(s), (c) the whole drive apparatus for the can is placed below the can, a height saving design being chosen. Thus the total machine heigth can be kept low, which facilitates operation of the machine.

(d) the drive apparatus is easily adaptable to changed depositing conditions of the fibre slivers, (e) by using toothed belt drives for the rotation of the can, as in the design examples according to FIGS. 1, 2, 4, 5 and 6, as well as for the rotation of the cranks, as in the design examples shown in FIGS. 1, 2 and 3, a particularly quiet and maintenance-free drive apparatus can be achieved.

While there are shown and described present preferred embodiments of the invention it is to be distinctly understood that the invention is not limited thereto but may be otherwise variously embodied and practised within the scope of the following claims. ACCORDINGLY,

I claim:

1. In a drive apparatus for a can for depositing textile fibre slivers in spinning preparatory machines, in which the can effects a rotational movement about its axis, and in which the can axis in turn rotates about an axis substantially parallel to it which is fixed with respect to space, the improvement which comprises:

at least one can table for supporting and centering the can;

a plate for rotatably supporting and driving the can table;

means for driving said can table and the can supported thereby; and said driving means including means for placing said plate into a translatory circular movement.

2. The drive apparatus as defined in claim 1, wherein:

said driving means comprises a force transmission device for rotating said can table; and said means for placing said plate into a translatory circular movement includes a plate drive element.

3. The drive apparatus as defined in claim 2, wherein:

said force transmission device comprises a flexible endless element.

4. The drive apparatus as defined in claim 3, wherein:

said flexible endless element is a toothed belt.

5. The drive apparatus as defined in claim 3, wherein:

said flexible endless element is a sprocket chain means.

6. The drive apparatus as defined in claim 3, further including:

a tension roll for tensioning said flexible endless element.

7. The drive apparatus as defined in claim 3, further including:

a plurality of said can tables rotatably supported by said plate; and said force transmission device comprises a single endless force transmission device for placing said can tables into rotation.

8. The drive apparatus as defined in claim 2, wherein:

said force transmission device comprises a plurality of mutually meshing gears; and knee lever means for supporting said meshing gears.

9. The drive apparatus as defined in claim 1, further including:

means for supporting said plate so as to be horizontally movable; and said means for placing said plate into a translatory circular movement comprises two cranks which operate essentially in mutual parallelism with respect to one another.

10. The drive apparatus as defined in claim 9, further including:

means for supporting said plate so as to be horizontally movable at least at three support points.

11. The drive apparatus as defined in claim 10, wherein:

at least one of said cranks is structured to define one of the support points for the plate.

12. The drive apparatus as defined in claim 9, wherein:

said driving means comprises a force transmission device for rotating said can table;

said means for placing said plate into a translatory circular movement further includes a plate drive element; and said plate drive element being rotatably connected with at least one of said cranks.

13. The drive apparatus as defined in claim 12, further including:

at least one gear for providing a rotational connection between the plate drive element and the crank.

14. The drive apparatus according to claim 12, further including:

a tooth belt for establishing a rotational connection between the plate drive element and the crank.

15. The drive apparatus as defined in claim 12, further including:

sprocket chain means for establishing a rotational connection between the plate drive element and the crank.

16. The drive apparatus as defined in claim 9, further including:

a plurality of said can tables rotatably supported by said plate.

17. The drive apparatus as defined in claim 9, wherein:

said supporting means comprises antifriction bearing means for supporting said plate and permitting two degrees of freedom of movement thereof.

18. The drive apparatus as defined in claim 9, wherein:

each of said cranks have an arm length; and means for adjustably varying the arm length of said cranks.

* * * * *